US008113381B2

(12) United States Patent
Che

(10) Patent No.: US 8,113,381 B2
(45) **Date of Patent: *Feb. 14, 2012**

(54) PET WASTE BAGS DISPENSER

(76) Inventor: Peter H Che, South El Monte, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/077,969

(22) Filed: Mar. 20, 2008

(65) Prior Publication Data

US 2008/0173662 A1 Jul. 24, 2008

Related U.S. Application Data

(63) Continuation-in-part of application No. 11/403,295, filed on Apr. 12, 2006.

(51) Int. Cl.
*B65D 83/00* (2006.01)
*A01K 1/064* (2006.01)

(52) U.S. Cl. ..... 221/64; 221/61; 221/62; 221/33; 221/281; 294/1.3; 206/390; 206/293; 206/233

(58) Field of Classification Search ..... 221/1–312 C, 221/64, 65, 70, 307, 281, 61, 62, 33; 294/1.3; 206/233, 293, 390; 150/144
See application file for complete search history.

(56) References Cited

U.S. PATENT DOCUMENTS 4,192,365 A * 3/1980 Siegel ..... 150/111
4,250,938 A * 2/1981 Siegel ..... 150/111
4,677,697 A * 7/1987 Hayes ..... 2/159
4,739,809 A * 4/1988 Adams ..... 150/112
4,778,283 A * 10/1988 Osborn ..... 383/71
4,893,739 A * 1/1990 Conner ..... 224/240
4,988,216 A * 1/1991 Lyman ..... 383/74
5,127,545 A * 7/1992 French ..... 221/102
5,560,321 A * 10/1996 Hess ..... 119/858
6,085,695 A * 7/2000 Miller et al. ..... 119/795
6,427,839 B1 * 8/2002 Helfer-Grand ..... 206/494
6,637,367 B1 * 10/2003 Dost et al. ..... 119/28.5
7,073,462 B1 * 7/2006 Layman ..... 119/161
7,300,395 B2 * 11/2007 Sleight et al. ..... 493/215
2004/0004013 A1 * 1/2004 Dleter et al. ..... 206/409
2005/0263087 A1 * 12/2005 Livingston, III ..... 119/161
2007/0241123 A1 * 10/2007 Che ..... 221/64

* cited by examiner

*Primary Examiner* — Michael K Collins
(74) *Attorney, Agent, or Firm* — Raymond Y. Chan; David and Raymond Patent Firm

(57) ABSTRACT

A pet waste bags dispenser provided for dispensing animal waste bags, having a collapsible container, a dispenser cavity cover and a dispensing means, wherein the dispensing means allows waste bags placed within the waste bags dispenser to be dispensed to a user easily and conveniently. The collapsible waste bags dispenser is made of a collapsible material, such that the dispenser is easy to store, light in weight, simple to manufacture, and has the flexibility to contain different amounts of waste bags within the collapsible container, wherein rolls of or individually wrapped waste bags are allowed to be dispensed. The collapsible waste bags dispenser further has external connecting means for connecting the waste bags dispenser to a foreign object, so as to facilitate the user to easily obtain a waste bag from the dispenser.

9 Claims, 7 Drawing Sheets

PET WASTE BAGS DISPENSER

CROSS REFERENCE OF RELATED APPLICATION

This is a Continuation-In-Part application of a non-provisional application having an application Ser. No. 11/403,295 and a filing date of Apr. 12, 2006.

BACKGROUND OF THE PRESENT INVENTION

1. Field of Invention

The present invention relates to a waste bag dispenser, and more particularly to a pet waste bags dispenser for pet waste bags, wherein the pet waste bags dispenser comprises a pouch structure for storing the pet waste bags, such that the pet waste bags can be dispensed conveniently, and the waste bag dispenser is easy to carry around, easy to store, light in weight, easy to manufacture and has a low manufacturing cost.

2. Description of Related Arts

Many people around the world have pets, especially those in developed countries. And people in the developed world are known to be very conscious about health and environment, which makes pet owners very careful about not leaving behind pet wastes when walking their pets. In fact, many developed countries have laws and regulations regarding pet wastes. Pet owners can receive citations when they get caught for not cleaning up after the pets.

Due to an advance in technology, as well as wealth, cleaning up pet wastes has advanced from using magazine pages and newspaper to using products specifically produced for picking up pet wastes.

Waste bags dispensers are already available in the market. However, such dispensers are heavy and bulky, making carrying around and storing difficult. They also consist of a lot of material and parts that may not be quite necessary. Such waste of material in turn creates a waste to the environment, which is not desired by most people.

In view of the above drawbacks, waste bags dispensers that are easy to store, and to use, cheaper to manufacture and consist of less parts has to be provided.

SUMMARY OF THE PRESENT INVENTION

A main object of the present invention is to provide a pet waste bag dispenser for dispensing pet waste bags, comprising a pouch body having a bag cavity provided for pet waste bags to be placed therewithin, a pouch cover provided for covering the bag cavity, preventing the waste bags from falling off the waste bags dispenser, means for detachably attaching the front cover edge of the pouch cover on the front wall of the pouch body, and a bag dispenser such that the waste bags are dispensed without the pouch cover being lifted up.

Another object of the present invention is to provide a pet waste bag dispenser, wherein the bag dispenser is on a front wall of the pouch body, such that the waste bags are dispensed with or without the pouch cover being closed.

Another object of the present invention is to provide a pet waste bag dispenser, further has a pouch carrier for easy carrying around and accessing of the waste bags in the pet waste bag dispenser.

Another object of the present invention is to provide a pet waste bag dispenser, wherein the pouch carrier forms a detachable loop for looping the pet waste bag dispenser onto a desired object.

Another object of the present invention is to provide a pet waste bag dispenser, wherein the pouch body has an elastic element for the pouch body to accommodate any amount of waste bags being placed within the dispenser cavity, wherein the pouch body will expand slightly when more waste bags are placed within the dispenser cavity, and will bind the waste bags even when there are a few waste bags placed within the dispenser cavity, such that the waste bags will not move around within the waste dispenser cavity.

Another object of the present invention is to provide a pet waste bag dispenser, so as to dispense rolls of waste bags.

Another object of the present invention is to provide a pet waste bag dispenser wherein all elements of the dispenser are undetachably attached together so as to achieve all of the above objectives with no detachable parts, such that the storage and usage of the waste bags dispenser are more efficient and effective.

Accordingly, in order to accomplish the above objects, the present invention provides a pet waste bag dispenser for pet waste bag, comprising:

a pouch body having a front wall, a rear wall and two sidewalls to form a bag cavity for storing the waste bag therein and a top opening communicating with the bag cavity; and a pouch cover, having a front cover edge, extended from the rear wall of the pouch body;

means for detachably attaching the front cover edge of the pouch cover on the front wall of the pouch body, wherein the pouch cover is frontwardly folded to cover the top opening of the pouch body so as to enclose the bag cavity for retaining the waste bags therein; and a bag dispenser provided on the front wall of the pouch body at a position below the front cover edge of the pouch cover when the pouch cover is detachably attached on the front wall, wherein the bag dispenser is adapted for allowing the waste bags to be dispensed out of the bag cavity when the bag cavity is enclosed by the pouch cover.

These and other objectives, features, and advantages of the present invention will become apparent from the following detailed description, the accompanying drawings, and the appended claims.

DETAILED DESCRIPTION OF THE PREFERRED EMBODIMENT

Figure 1:
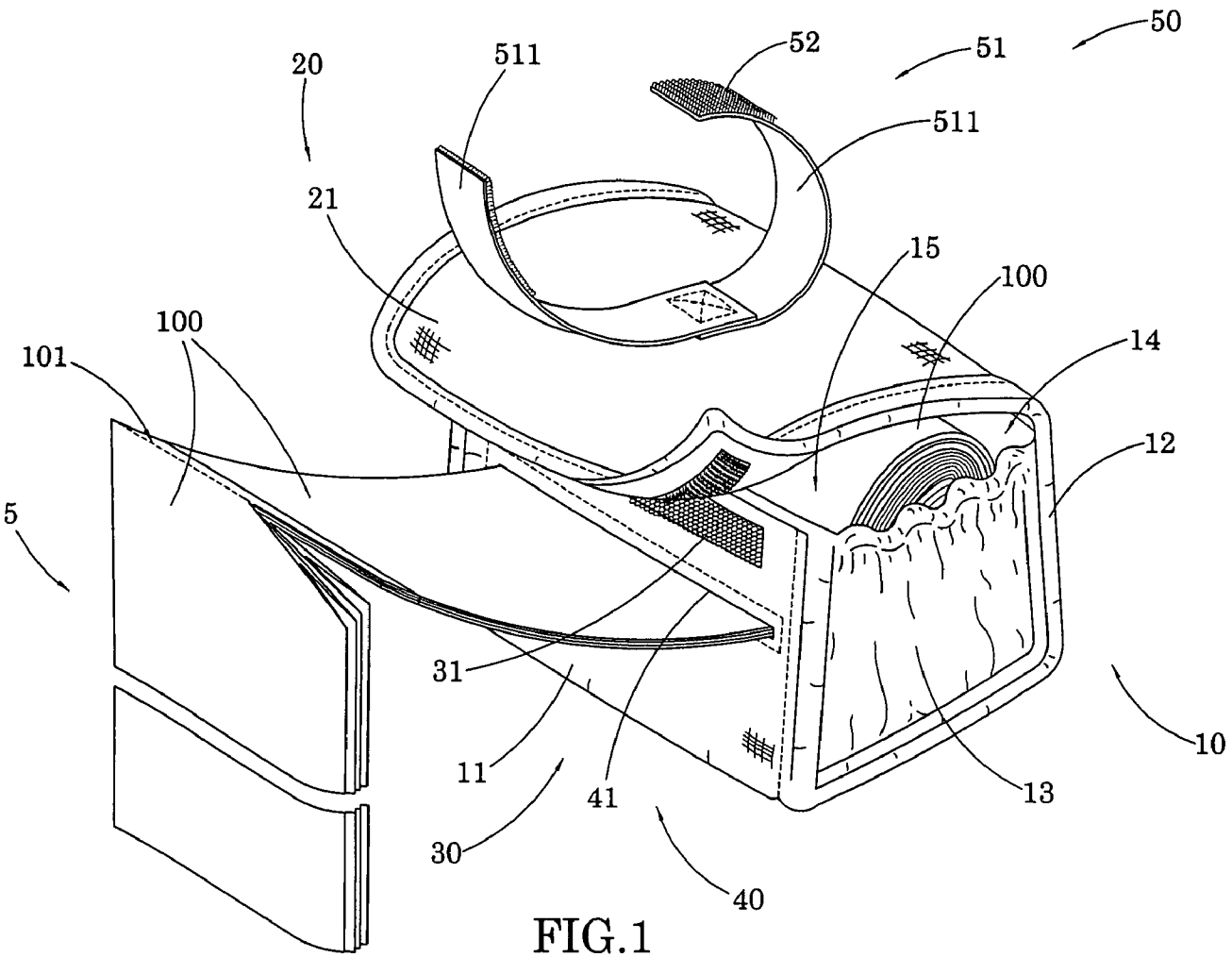
FIG. 1 is a perspective view of the pet waste bag dispenser according to the preferred embodiment of the present invention.

Referring to FIG. 1 of the drawings, a pet waste bags dispenser for pet waste bags according to a preferred embodiment of the present invention is illustrated, wherein the pet waste bags dispenser comprises a pouch body 10, a pouch cover 20, means 30 for detachably attaching the front cover edge of the pouch cover on the wall of the pouch body, and a bag dispenser 40.

The pouch body has a front wall 10, a rear wall 11 and two sidewalls 12, to form a bag cavity 14. The bag cavity 14 is provided for waste bag 5 to be stored therein. The pouch body also has a top opening 15 for communicating with the bag cavity 14, such that the waste bags can be refilled into the bag cavity 14 through the top opening 15.

According to the preferred embodiment of the present invention, the waste bags dispenser is designed for a roll of rectangular shaped bags, such that the waste bags can easily be dispensed continuously.

The pouch cover 20 is provided for covering a top opening 15 of the bag cavity 14, so as to protect the waste bags 5 placed within the bag cavity 14 through the top opening 15, prevent the waste bags 5 from falling off the bag cavity 14, or from damages. The pouch cover 20 is extended from the rear wall 11 of the pouch body 10, and has a front cover edge 21.

In order to ensure that the top opening 15 is to remain closed, the pet waste bag dispenser has means 30 for detachably attaching the front cover edge 21 of the pouch cover 20 on the front wall 13 of the pouch body 10, wherein the pouch cover 20 is frontwardly folded to cover the top opening 15 of the pouch body 10 so as to enclose the bag cavity 14 and retaining the waste bags 5 therein.

It is worth mentioning that, the pouch cover 20 does not need to be separately formed, reducing the number of manufacturing procedures and less material will be used. Also, the means 30 ensures that the pouch cover 20 will not accidentally open up and let the waste bags 5 to spill out of the bag cavity 14.

According to the preferred embodiment of the present invention, the means 30 comprises a first fastener 31 and a second fastener 32, wherein the first fastener 31 is provided on the front wall 11 of the pouch body 10 above the bag dispenser, and the second fastener 32 is provided on the pouch cover 20 and is arranged to detachably fasten with the first fastener 31 such that the pouch cover 20 is retained in a closed position. Of course, the means 30 can be other connectors too, including button snap, button and hole, and other detachable adhesive means.

It should be noted that, according to the preferred embodiment of the present invention, the first fasteners 31 and second fasteners 32 are a pair of hook and loop fasteners respectively.

The bag dispenser 40 is provided for the waste bags 5 inside the bag cavity 14 to be dispensed out of the waste bags dispenser. According the preferred embodiment of the invention, the bag dispenser 40 is provided on the front wall 11 of the pouch body 10 preferably at a position below the front cover edge 21 of the pouch cover 20 when the pouch cover 20 is detachably attached on the front wall 11.

The bag dispenser 40 is adapted for allowing the waste bags 5 to be dispensed out of the bag cavity 14 when the bag cavity 14 is enclosed by the pouch cover 20, such that the waste bags 5 can be pulled out of the bag cavity 14 without having to use both hands to hold on to the waste bag dispenser or to have to open up the pouch cover 20 to reach the waste bags 5 in the bag cavity 14, allowing a user to effortlessly utilize the waste bags 5, when he/she might not have both hands free.

According to the preferred embodiment of the present invention, the bag dispenser 40 of the waste bags dispenser contains a dispensing slit 41, which is transversely formed on the front wall 11 of the pouch body 10 for the waste bag 5 to slide out of the bag cavity 14 through the dispensing slit 41.

It should be noted that the dispensing slit 41 has a width larger than a width of the waste bag 5 in a folded manner while the waste bag is rolled to be stored in the bag cavity 14, or else the waste bags 5 may not easily dispensed out of the bag cavity 14.

It is worth mentioning that the pet waste bags dispenser, including the pouch body 10 and the pouch cover 20, is made of a collapsible material, which enables the pet waste bag dispenser, when empty, to be easily folded, occupying less space and effectively stored inside the pocket of the user. It means that when the user stores the waste bags dispenser inside his pocket, there will be no bulging, and therefore no one can see it.

The pet waste bag dispenser further comprises pouch carrier 50 provided for the waste bags dispenser be carried around. The pouch carrier 50 enables the user to link the waste bags dispenser to a foreign object which allows the user to easily obtain a waste bag 5 from the waste bags dispenser without having to hold on to the pet waste bag dispenser.

By allowing the user to obtain a waste bag 5 from the waste bags dispenser with only one hand, without having to hold on to the waste bags dispenser, ensures that the user does not have to loose concentration in watching his or her dog wile obtaining a waste bag 5. Imagine if a user has to hold the waste bags dispenser with both hands while trying to hold on to the leash of the dog, him or her may easily loose the leash of the dog and create hazard to both the dog and other pedestrians around.

The pouch carrier 50 comprises a carrier strap 51, which is attached to the pouch cover 20 and a fastener element 52 provided on the carrier strap 51 in such a manner that two free ends 511 of the carrier strap 51 are detachably attached to form a carry loop for the pouch body 10 to be carried.

Figure 2:
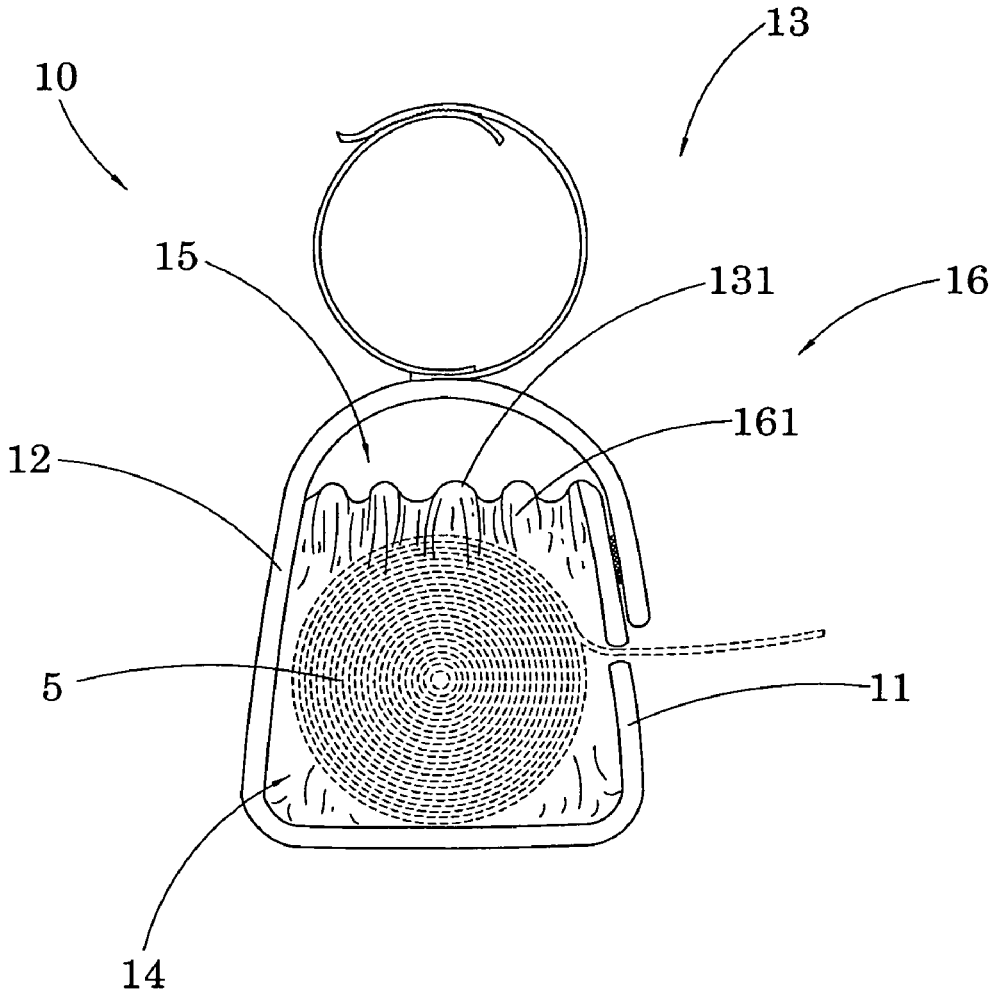
FIG. 2 is a cross-sectional view of the pet waste bag dispenser according to the above preferred embodiment of the present invention.

Referring to FIG. 2 of the drawings, according to the preferred embodiment of the present invention, in order to flexibly and comfortably accommodate different amount of waste bags 5 within the bag cavity 14, the pouch body 10 further comprises an elastic element 16, which is provided on the pouch body 10 at the top opening 15. The effect of having the elastic element 16 is to shrink a size of the top opening 15 for securely retaining the waste bag 5 within the bag cavity 14.

Also according to the preferred embodiment of the present invention, the elastic element 16 comprises two elastic bands 161. The elastic bands 161 are provided along top edges 131 of the sidewalls 13 respectively, so as to substantially pull the front wall 11 and the rear wall 12 towards each other so as to form the bag cavity 14 having a trapezoid cross section.

Basically, when there are fewer waste bags 5 in the pouch body 10, the flexible elastic element 16 prevents the waste bags 5 from falling out off the bag cavity 14 due to the emptiness within the bag cavity 14. And, when there are many waste bags 5 in the pouch body 10, the elastic element 16 expands to bind around the waste bags 5 within the pouch body 10, such that the waste bags 5 will not ooze out of the bag cavity 14 simply because the bag cavity 14 is fuller.

The waste bags dispenser can be useful not only for pet's waste, but also for many other purposes. For example, the bags can be used to carry diapers or sanitary napkins.

Figure 3:
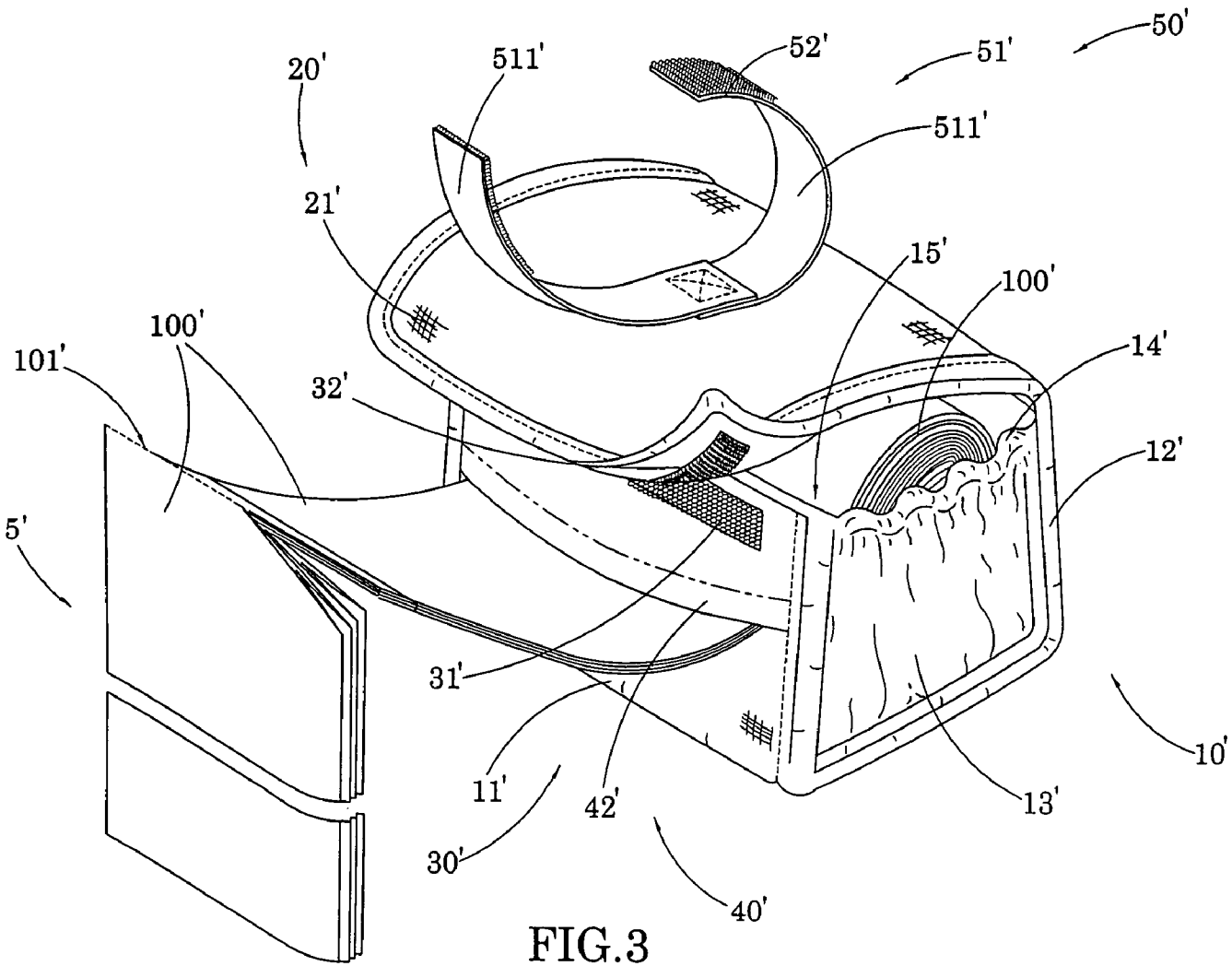
FIG. 3 is a perspective view of the pet waste bag dispenser according to the preferred embodiment of the present invention.

Referring to FIG. 3 of the drawings, a pet waste bags dispenser for pet waste bags according to a preferred embodiment of the present invention is illustrated, wherein the pet waste bags dispenser comprises a pouch body 10', a pouch cover 20', means 30' for detachably attaching the front cover edge of the pouch cover on the wall of the pouch body, a bag dispenser 40', and plurality of waste bags 5'.

The pouch body has a front wall 11', a rear wall 12' and two sidewalls 13', to form a bag cavity 14'. The bag cavity 14' is provided for waste bag 5' to be stored therein. The pouch body 10' also has a top opening 15' for communicating with the bag cavity 14', such that the waste bags can be refilled into the bag cavity 14' through the top opening 15'.

The pouch cover 20' is provided for covering a top opening 15' of the bag cavity 14', so as to protect the waste bags 5' placed within the bag cavity 14' through the top opening 15', prevent the waste bags 5' from falling off the bag cavity 14', or from damages. The pouch cover 20' is extended from the rear wall 11' of the pouch body 10', and has a front cover edge 21'.

The top opening 15' is made of elastic material to remain closed, and is easy to be opened for refilling waste bags 5'. In a preferred embodiment, the top opening comprises a front edge 151', a rear edge 152', and two elastic sides 153'. During normal time the top opening is remaining closed. The two elastic sides 153' shrink and pull the front edge 151' and the rear edge 152' towards each other by elastic force to close the pouch body 10'. To open the top opening 15', just pull the front edge 151' and the rear edge 152' away from each other, and the front edge 151', the rear edge 152', with the elastic sides 153' form an open area for the pouch body 10'.

Figure 6:
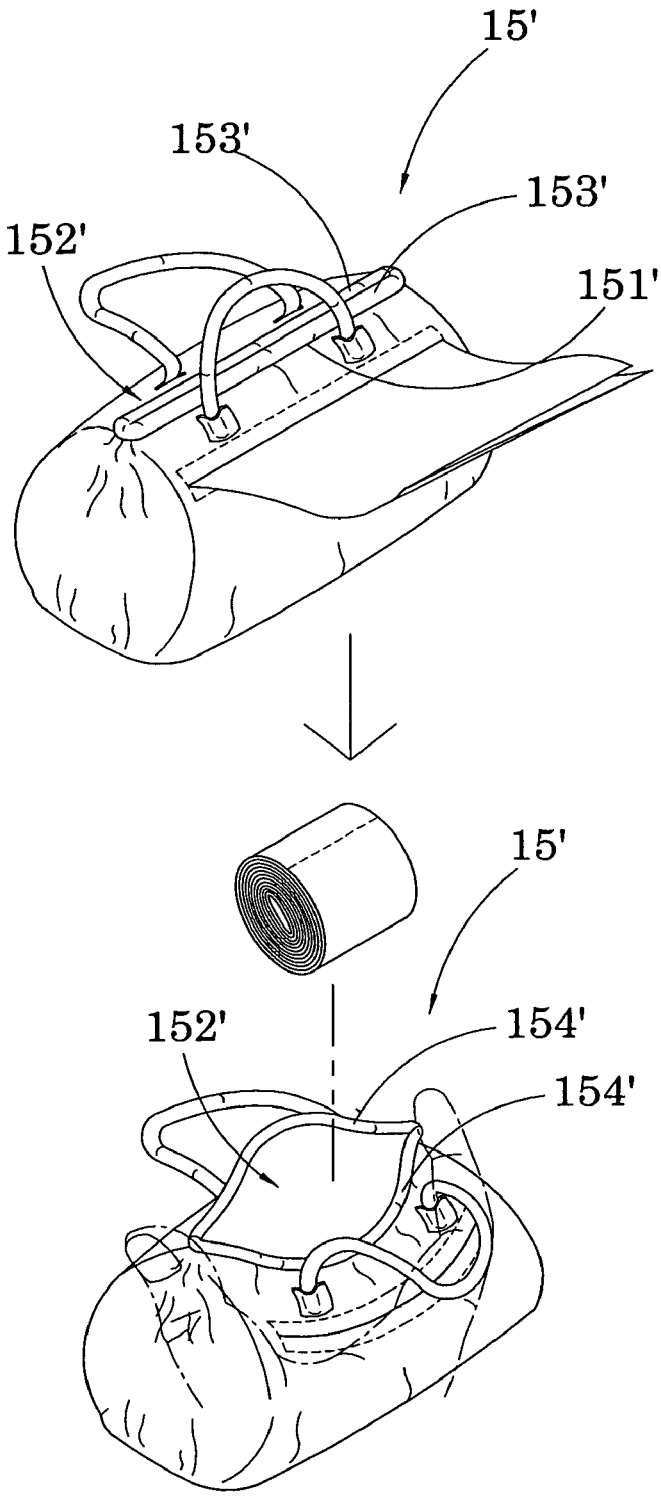
FIG. 6 is a perspective view of an alternative embodiment of the present invention, the top opening of the bag is made of two elastic edges.
Figure 7:
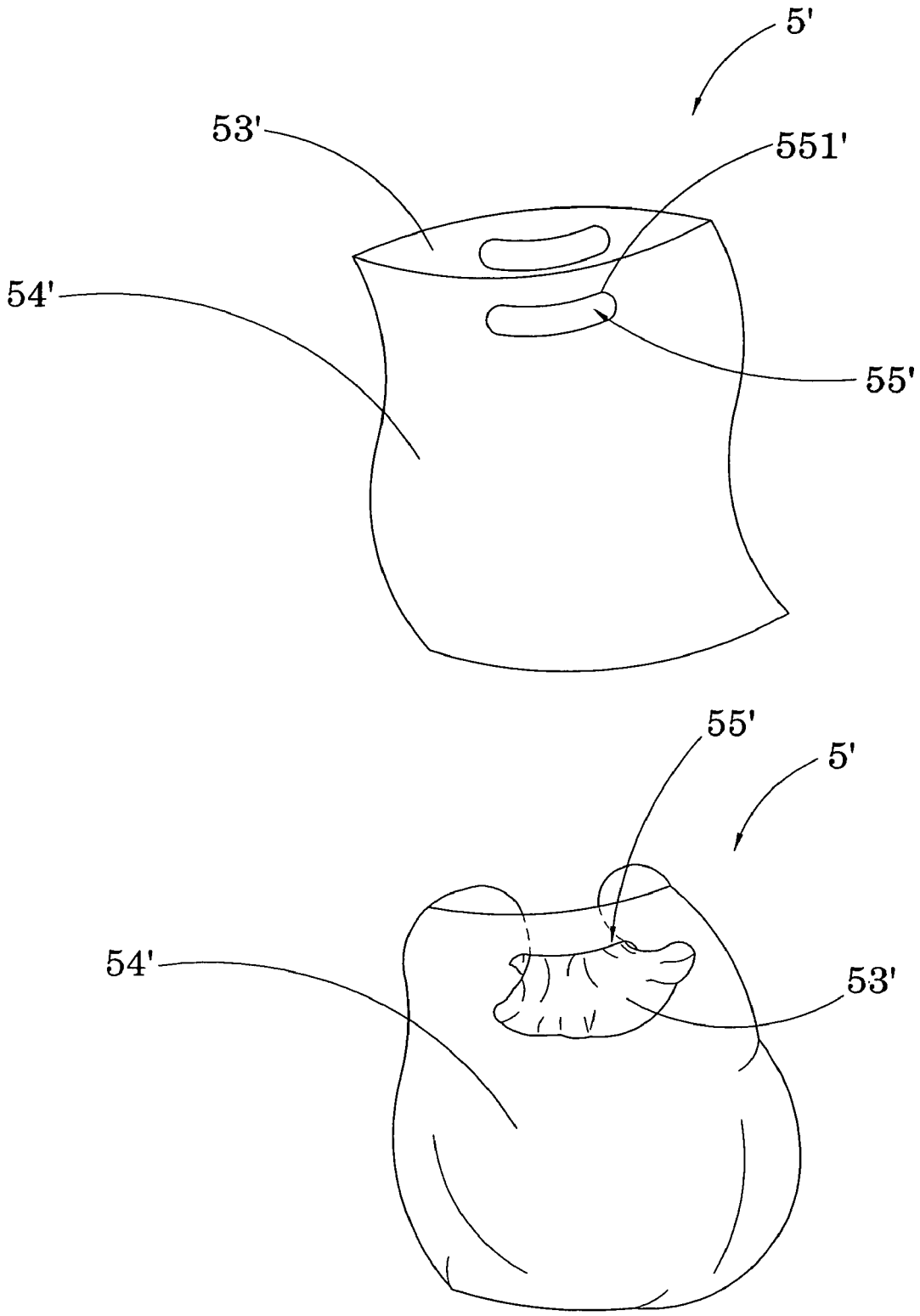
FIG. 7 is a perspective view of the waste bag which can be sealed by pulling the edge through the sealing slit.

Referring to FIG. 6, in an alternative embodiment, the top opening 15' comprises two straight edges 154'. These two elastic edges 154' are placed facing each other parallely. The ends of one elastic edge 154' are connected with the ends of another elastic edge 154' relatively. So in normal time these two elastic edges 154' attached with each other and close the top opening 15'. While the elastic edges 154' are made of elastic material and can be bent in a curve. When pull the two elastic edges 154' away from each other, the top opening 15' will be opened. And when release, the two elastic edges 154' will return to the original shape and attach each other to close the top opening 15' by elastic force.

In an alternative embodiment, the whole edge of the top opening 15' is made of elastic material. During normal time, the top opening 15' is closed with the edge shrinking together by elastic fore. When stretch the edge of the top opening 15', the top opening 15' is opened.

In order to ensure that the top opening 15' is to remain closed, the pet waste bag dispenser has means 30' for detachably attaching the front cover edge 21' of the pouch cover 20' on the front wall 13' of the pouch body 10', wherein the pouch cover 20' is frontwardly folded to cover the top opening 15' of the pouch body 10 so as to enclose the bag cavity 14' and retaining the waste bags 5' therein.

It is worth mentioning that, the pouch cover 20' does not need to be separately formed, reducing the number of manufacturing procedures and less material will be used. Also, the means 30' ensures that the pouch cover 20' will not accidentally open up and let the waste bags 5' to spill out of the bag cavity 14'.

According to the preferred embodiment of the present invention, the means 30' comprises a first fastener 31' and a second fastener 32', wherein the first fastener 31' is provided on the front wall 11' of the pouch body 10' above the bag dispenser, and the second fastener 32' is provided on the pouch cover 20' and is arranged to detachably fasten with the first fastener 31' such that the pouch cover 20' is retained in a closed position. Of course, the means 30' can be other connectors too, including button snap, button and hole, and other detachable adhesive means.

It should be noted that, according to the preferred embodiment of the present invention, the first fasteners 31' and second fasteners 32' are a pair of hook and loop fasteners respectively.

The bag dispenser 40' is provided for the waste bags 5' inside the bag cavity 14' to be dispensed out of the waste bags dispenser. According the preferred embodiment of the invention, the bag dispenser 40' is provided on the front wall 11' of the pouch body 10 preferably at a position below the front cover edge 21' of the pouch cover 20' when the pouch cover 20' is detachably attached on the front wall 11'.

The bag dispenser 40' is adapted for allowing the waste bags 5' to be dispensed out of the bag cavity 14' when the bag cavity 14 is enclosed by the pouch cover 20', such that the waste bags 5' can be pulled out of the bag cavity 14' without having to use both hands to hold on to the waste bag dispenser or to have to open up the pouch cover 20' to reach the waste bags 5' in the bag cavity 14', allowing a user to effortlessly utilize the waste bags 5', when he/she might not have both hands free.

According to the preferred embodiment of the present invention, the bag dispenser 40' of the waste bags dispenser contains a dispensing slit 41', which is transversely formed on the front wall 11' of the pouch body 10' for the waste bag 5' to slide out of the bag cavity 14' through the dispensing slit 41'. The bag dispenser 40' also comprises a front edge 42' and a back edge 43' along the dispensing slit 41' and form the dispensing slit 41' wherein the front edge 42' and the back edge 43' are overlapped in such a manner the front edge 42' covers the back edge 43'. As a result, the dispensing slit 41' does not expose the waste bags 5' inside the pouch body 10' directly to the air. First, the overlapped edges prevent dirt, water or other unwanted stuff entering into the pouch body 10'; second, the overlapped edges fold the waste bags when it is pulling out, this increases the friction force and prevent more waste bags being pulled out, and keep a portion of the next waste bag 5' remaining in the slit 41'for the user's convenience to pull out next time, other wise the next waste bag 5' can be rolled back into to pouch body 10', or pulled out together with the previous waste bag 5'.

It should be noted that the dispensing slit 41' has a width larger than a width of the waste bag 5' in a folded manner while the waste bag is rolled to be stored in the bag cavity 14, or else the waste bags 5' may not easily dispensed out of the bag cavity 14'.

It is worth mentioning that the pet waste bags dispenser, including the pouch body 10' and the pouch cover 20', is made of a collapsible material, which enables the pet waste bag dispenser, when empty, to be easily folded, occupying less space and effectively stored inside the pocket of the user. It means that when the user stores the waste bags dispenser inside his pocket, there will be no bulging, and therefore no one can see it.

The pet waste bag dispenser further comprises pouch carrier 50' provided for the waste bags dispenser be carried around. The pouch carrier 50' enables the user to link the waste bags dispenser to a foreign object which allows the user to easily obtain a waste bag 5' from the waste bags dispenser without having to hold on to the pet waste bag dispenser.

By allowing the user to obtain a waste bag 5' from the waste bags dispenser with only one hand, without having to hold on to the waste bags dispenser, ensures that the user does not have to loose concentration in watching his or her dog wile obtaining a waste bag 5'. Imagine if a user has to hold the waste bags dispenser with both hands while trying to hold on to the leash of the dog, him or her may easily loose the leash of the dog and create hazard to both the dog and other pedestrians around.

The pouch carrier 50' comprises a carrier strap 51', which is attached to the pouch cover 20' and a fastener element 52' provided on the carrier strap 51' in such a manner that two free ends 511' of the carrier strap 51' are detachably attached to form a carry loop for the pouch body 10' to be carried.

Figure 4:
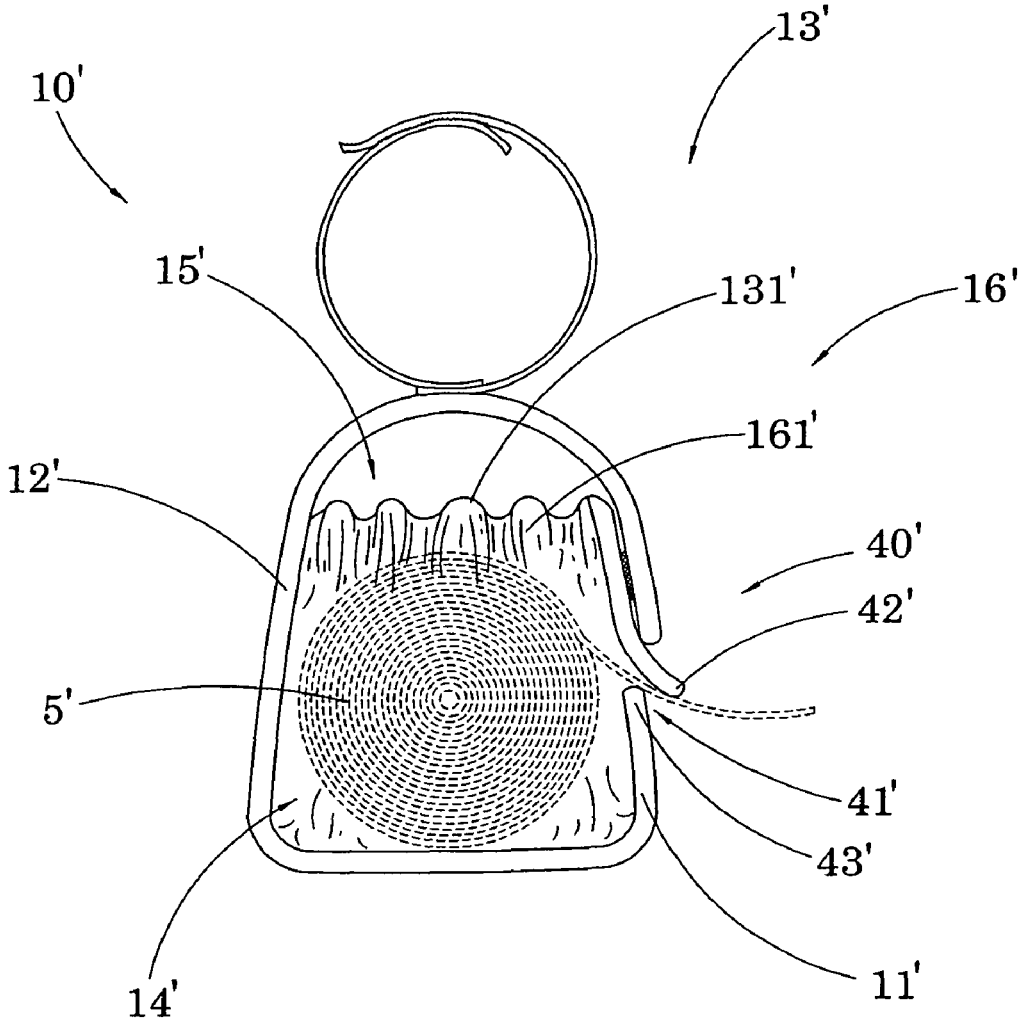
FIG. 4 is a cross-sectional view of the pet waste bag dispenser according to the above preferred embodiment of the present invention.

Referring to FIG. 4 of the drawings, according to the preferred embodiment of the present invention, in order to flexibly and comfortably accommodate different amount of waste bags 5' within the bag cavity 14', the pouch body 10' further comprises an elastic element 16', which is provided on the pouch body 10' at the top opening 15'. The effect of having the elastic element 16' is to shrink a size of the top opening 15' for securely retaining the waste bag 5' within the bag cavity 14'.

Also according to the preferred embodiment of the present invention, the elastic element 16' comprises two elastic bands 161'. The elastic bands 161' are provided along top edges 131' of the sidewalls 13' respectively, so as to substantially pull the front wall 11' and the rear wall 12' towards each other so as to form the bag cavity 14' having a trapezoid cross section.

Basically, when there are fewer waste bags 5' in the pouch body 10', the flexible elastic element 16' prevents the waste bags 5' from falling out off the bag cavity 14' due to the emptiness within the bag cavity 14'. And, when there are many waste bags 5' in the pouch body 10', the elastic element 16' expands to bind around the waste bags 5' within the pouch body 10', such that the waste bags 5' will not ooze out of the bag cavity 14' simply because the bag cavity 14' is fuller.

Figure 5A:
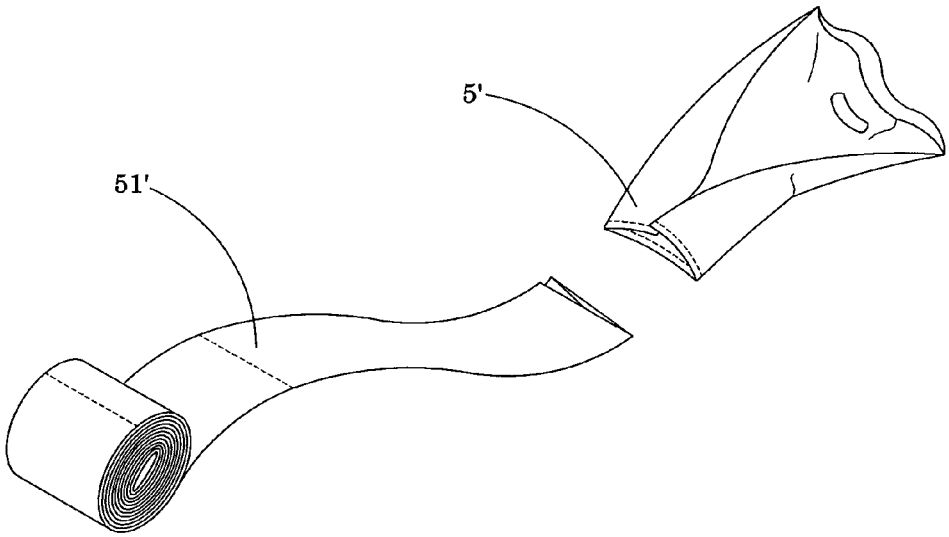
FIG. 5A is a perspective view of the bag roll wherein the waste bags are detachably connected.

Referring to FIG. 5, the waste bags are installed inside the pouch body 10' in a predetermined manner for the sake of easy pulling out continuously. In the first embodiment as illustrated in FIG. 5A, all the waste bags are detachably connected continuously, and are rolled together into a bag roll 51'. The bag roll 51' is transversely stored in the bag cavity 14' with the roll axes parallel to the dispensing slit 41'. The end of the rolling bags is slid out of the pouch body 10' thought the dispensing slit 41', so the user can reach the waste bag without opening the pouch body 10'. Since the waste bags 5' are detachably connected, when one waste bag 5' is pulled out, a portion of the bag roll 51' is pulled out accordingly. When the waste bag 5' is detached, a portion of the end of the bag roll 51' remains outside of the pouch body 10' though the dispensing slit 41', so next time, the next waste bag 5' will be easy to pull out. In the preferred embodiment, the waste bags 5' are prefabricated in a continuous sheet, the connection of every two bags are pre-punched or half cut so the waste bags can be detached from the sheet.

Figure 5B:
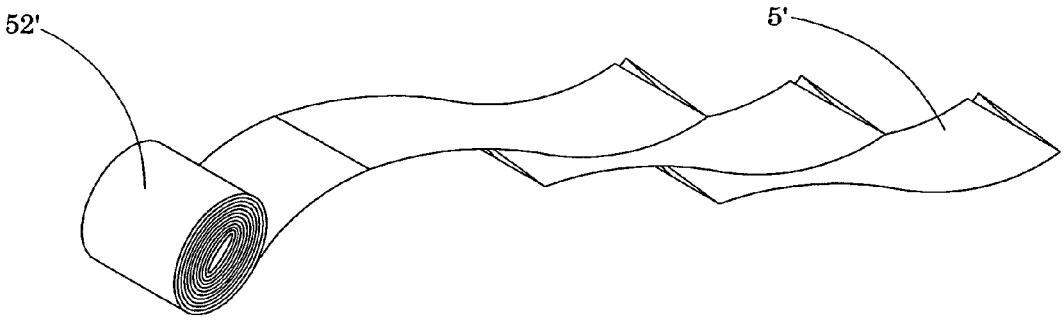
FIG. 5B is a perspective view of the bag roll wherein each bag is rolled into the bag roll with a portion overlapped with the previous and the next bags.

Referring to FIG. 5B, in the second embodiment, the waste bags 5' are rolled into a bag roll 52' wherein each bag is rolled into the bag roll with a portion overlapped with the previous and the next bags. So when one waste bag 5' is pulled out from the dispensing slit 41', a portion of the next bag is pulled out too, and the bag roll 52' is rolled inside the bag cavity 14' accordingly.

In order to smaller the width of the waste bags to save space, all bags are tree-folded. So in both embodiments, the width of the bag roll is one third of the real width of the waste bags.

Each waste bag 5' further comprises an opening 53', a bag wall 54', and a sealing slit 55' for sealing the waste bag 5' easily. Referring to FIG. 6, the sealing slit 55' is cut in U-shape on the bag wall 54' near the opening 53' of the waste bag 5'. The upper edge 551' of the sealing slit 55' can be lift up to make a through hole on the bag wall 53'. When the waste bag 5' needs to be sealed, the edge of the opening 53' which is opposite to the sealing slit 55' is pulled through the sealing slit 55' from one side to another, then the opening 53' of the waste bag 5' is squeezed and sealed. The sealing slit 55' holds the edge of the opening 53' for fastening. In this way, no other fasteners, such as rubber band, thread, or clamps are needed for sealing the waste bag 5'.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A waste bag dispenser, comprising:

a plurality of waste bags, wherein said waste bags are stored in said bag cavity as a bag roll, wherein said each waste bag has a portion of its edges overlapped with the previous and the next waste bag in said bag roll;

a pouch body having a front wall, a rear wall and two sidewalls to form a bag cavity for storing said waste bags therein and a top opening communicating with said bag cavity; wherein said top opening comprises a front edge at said front wall, a rear edge at said rear wall, and two elastic edges at two top edges of said sidewalls respectively, wherein said two elastic edges pull said front and rear edges towards each other to close said top opening by elastic force; and a pouch cover, having a front cover edge, extended from said rear wall of said pouch body;

means for detachably attaching said front cover edge of said pouch cover on said front wall of said pouch body, wherein said pouch cover is frontwardly folded to cover said top opening of said pouch body so as to enclose said bag cavity for retaining said waste bags therein; and a bag dispenser, having a dispensing slit, provided on said front wall of said pouch body at a position below said front cover edge of said pouch cover when said front cover edge of said pouch cover is detachably attached on said front wall, wherein said bag dispenser is adapted for allowing said waste bags to be dispensed out of said bag cavity when said bag cavity is enclosed by said pouch cover, wherein said dispensing slit is transversely formed on said front wall of said pouch for each of said waste bags sliding out of said bag cavity through said dispensing slit, wherein said dispensing slit comprises a front edge and a back edge wherein said front edge and said back edge are overlapped, so that said front edge covers said back edge from outside of said pouch body, wherein when the previous waste bag is dispensed out of said pouch body through said dispensing slit, said edge of said next waste bag is held between said front and back edges of said dispensing slit.

2. The pet waste bag dispenser, as recited in claim 1, wherein said waste bags are detachably connected continuously in said bag roll.

3. The pet waste bag dispenser, as recited in claim 2, wherein said waste bags are stored in said bag cavity trifolded.

4. The pet waste bag dispenser, as recited in claim 1, wherein said waste bag comprises a sealing slit below the top edge of said opening of said waste bag, wherein said opening of said waste bag is sealed by polling said top edge opposite to said sealing slit through said sealing slit.

5. The pet waste bag dispenser, as recited in claim 2, wherein said waste bag comprises a sealing slit below the top edge of said opening of said waste bag, wherein said opening of said waste bag is sealed by pulling said top edge opposite to said sealing slit through said sealing slit.

6. The pet waste bag dispenser, as recited in claim 3, wherein said waste bag comprises a sealing slit below the top edge of said opening of said waste bag, wherein said opening of said waste bag is sealed by pulling said top edge opposite to said sealing slit through slit said sealing slit.

7. The pet waste bag dispenser, as recited in claim 4, wherein said sealing slit is in U-shape wherein the upper edge of said sealing slit is able to be lifted up to make a through hole for said top edge of said opening of said waste bag to be pulled though.

8. The pet waste bag dispenser, as recited in claim 5, wherein said sealing slit is in U-shape wherein the upper edge of said sealing slit is able to be lifted up to make a through hole for said top edge of said opening of said waste bag to be pulled though.

9. The pet waste bag dispenser, as recited in claim 6, wherein said sealing slit is in U-shape wherein the upper edge of said sealing slit is able to be lifted up to make a through hole for said top edge of opening of said waste bag to be pulled though.

* * * * *